US012208863B2

(12) United States Patent
Bless et al.

(10) Patent No.: US 12,208,863 B2
(45) Date of Patent: Jan. 28, 2025

(54) DEVICE AND SYSTEM FOR PREVENTING THEFT OF MARINE ELECTRONICS

(71) Applicants: Patrick D. Bless, Lighthouse Point, FL (US); Michael L. Grant, Boynton Beach, FL (US)

(72) Inventors: Patrick D. Bless, Lighthouse Point, FL (US); Michael L. Grant, Boynton Beach, FL (US)

( * ) Notice: Subject to any disclaimer, the term of this patent is extended or adjusted under 35 U.S.C. 154(b) by 0 days.

(21) Appl. No.: 18/423,650

(22) Filed: Jan. 26, 2024

(65) Prior Publication Data

US 2024/0253742 A1 Aug. 1, 2024

Related U.S. Application Data

(60) Provisional application No. 63/441,600, filed on Jan. 27, 2023.

(51) Int. Cl.
*B63B 17/00* (2006.01)
*B63B 49/00* (2006.01)

(52) U.S. Cl.
CPC ..... *B63B 17/00* (2013.01); *B63B 49/00* (2013.01); *B63B 2017/0009* (2013.01)

(58) Field of Classification Search
CPC . B63B 17/00; B63B 2017/0009; B63B 49/00; B60R 2011/0005; B60R 2011/0096; E05B 67/38; E05B 2067/383; E05B 2067/386; B60K 2360/682; Y10T 70/554; Y10T 70/5544; Y10T 70/5549; Y10T 70/5566; Y10T 70/558; H01H 9/281; H01H 9/282; H01H 9/283; H01H 9/287; H01R 13/447; H01R 13/453; H01R 13/4532; H01R 13/4538; H01R 13/6397; H02G 3/14
See application file for complete search history.

(56) References Cited

U.S. PATENT DOCUMENTS 1,004,758 A * 10/1911 Ebbert ..... E05B 65/467 70/423
1,328,109 A * 1/1920 Whitlock ..... H01H 9/282 70/2
1,801,228 A * 4/1931 Edhlund ..... H01H 9/282 70/DIG. 58
3,814,205 A * 6/1974 Miller ..... B60K 37/00 296/70

(Continued)

*Primary Examiner* — Ajay Vasudeva
(74) *Attorney, Agent, or Firm* — Shore IP Group, PLLC; Sean R. Wilsusen

(57) ABSTRACT

A system for preventing theft of marine electronics includes a bracket configured to be mounted to a hull of a vessel. The bracket includes a projection and an orifice defined through the projection. The orifice of the projection is configured to receive a lock. A panel is secured to the hull of the vessel by the bracket. The panel includes an orifice configured to receive the projection of the bracket. The panel is configured to substantially cover a marine electronics unit to prevent theft of the unit. A handle extends from the panel. The handle is configured to move the panel between a first orientation in which the projection of the bracket is arranged in the orifice of the panel to secure the panel to the hull of the vessel, and a second orientation in which the panel is removed from the hull of the vessel.

18 Claims, 15 Drawing Sheets

(56) References Cited

U.S. PATENT DOCUMENTS

| | | | | | |
|---|---|---|---|---|---|
| 4,113,291 | A * | 9/1978 | Cameron | E05B 67/383 | 292/281 |
| 4,131,173 | A * | 12/1978 | Boersma | B60K 35/00 | 70/160 |
| 4,607,900 | A * | 8/1986 | Andrews | H01R 13/6397 | 439/150 |
| 5,165,262 | A * | 11/1992 | Brem | E02F 9/24 | 70/160 |
| 6,578,393 | B2 * | 6/2003 | Yarborought | E05B 67/38 | 70/52 |
| 2006/0037794 | A1 * | 2/2006 | Riha | B60K 37/00 | 180/90 |

* cited by examiner

DEVICE AND SYSTEM FOR PREVENTING THEFT OF MARINE ELECTRONICS

CROSS-REFERENCE TO RELATED APPLICATION

This U.S. Non-Provisional Patent application claims priority to U.S. Provisional Patent Application No. 63/441,600, filed on Jan. 27, 2023, the entire disclosure of which is incorporated by reference herein.

FIELD

The present disclosure relates to marine electronics and, more particularly, to a device and system for preventing theft of marine electronics.

BACKGROUND

Marine electronics include electronics devices utilized in a marine environment on vessels, such as boats, ships, yachts, kayaks, and other watercraft. Marine electronics are designed to withstand, for example, a damp or even a saltwater environment. Marine electronics devices may include chartplotters, multifunctional displays, GPS, marine VHF radios, autopilots, self-steering devices, fishfinder machines and sonar machines, depth gauges, marine radar displays, fiber optic gyrocompasses, audio and stereo systems, satellite televisions, vessel management systems and/or marine fuel management devices. Such devices are often installed in various locations in the hull of a vessel. For example, devices employing a screen are often flush mounted in a console, helm, or a pilot house of a vessel. However, as the sophistication, cost, and value of such marine electronics devices has increased, a corresponding increase in theft of such devices has been observed and documented.

SUMMARY

Provided in accordance with aspects of the present disclosure is a system for preventing theft of marine electronics including at least one bracket configured to be mounted to a hull of a vessel, such as a boat, ship, kayak, or other watercraft. The bracket(s) include(s) a projection and an orifice defined through the projection of the bracket(s). The orifice of the projection is configured to receive a lock. A panel is secured to the hull of the vessel by the bracket. The panel includes an orifice configured to receive the projection of the bracket(s) to secure the panel to the hull of the vessel. The panel is configured to substantially cover at least one marine electronics unit to prevent theft of the marine electronics unit. At least one handle extends from the panel. The handle(s) is/are configured to move the panel between a first orientation in which the projection of the bracket(s) is/are arranged in the orifice of the panel to secure the panel to the hull of the vessel, and a second orientation in which the panel is removed from the hull of the vessel.

In an aspect of the present disclosure, a lock is received in the orifice of the projection to secure the panel to the hull of the vessel.

In an aspect of the present disclosure, the bracket includes a base member configured to be secured to the hull of the vessel and the projection extends from the base member.

In an aspect of the present disclosure, at least one orifice is defined through the base member of the bracket. The orifice of the base member is configured to receive a counter sunk head of a screw to secure the base member to the hull of the vessel.

In an aspect of the present disclosure, the base member defines a substantially flat surface configured to contact the panel when the panel is secured to the hull of the vessel.

In an aspect of the present disclosure, the handle includes a first projection extending from a bottom end portion of the panel. A second projection extends from an upper end portion of the panel. A connecting portion connects the first projection and the second projection to define the handle.

In an aspect of the present disclosure, the connecting portion of the handle is configured to overlap with the bracket along an axis orthogonal to a front surface of the panel configured to face away from the marine electronics unit to prevent tampering with a lock arranged in the orifice of the projection.

In an aspect of the present disclosure, a gasket is arranged around a perimeter of the panel between the panel and the hull of the vessel. The gasket is configured to close a gap between the panel and the hull of the vessel to prevent tampering with the panel.

In an aspect of the present disclosure, a groove is formed on a rear surface of the panel configured to face the marine electronics unit. The gasket is partially arranged in the groove and partially protrudes from the groove to secure the gasket to the panel and to close the gap between the panel and the hull of the vessel to prevent tampering with the panel.

In an aspect of the present disclosure, the gasket includes rubber, silicone, neoprene, aramid fibers, glass fibers, non-asbestos fibers, elastomers, Polytetrafluoroethylene (PTFE), graphite, cork, or plastic.

In an aspect of the present disclosure, at least one of the bracket, the panel, or the handle includes a metal.

In an aspect of the present disclosure, the metal includes stainless steel, galvanized steel, carbon, a steel alloy, brass, aluminum, or bronze.

In an aspect of the present disclosure, a first bracket is configured to be mounted to a first side of a center console of the hull of the vessel, and a second bracket is configured to be mounted to a second side of the center console of the hull of the vessel.

In an aspect of the present disclosure, a first orifice is configured to be aligned with the first bracket, and a second orifice is configured to be aligned with the second bracket.

In an aspect of the present disclosure, a first bracket includes the projection, and a second bracket includes a channel configured to receive a protrusion extending from a rear surface of the panel. The rear surface of the panel is configured to face the marine electronics unit.

In an aspect of the present disclosure, a first handle extends from a first side of the panel, and a second handle extends from a second side of the panel opposite the first side of the panel.

In an aspect of the present disclosure, the bracket is configured to be secured to the hull of the vessel by a number of screws or bolts. The panel is configured to cover the heads of each of the screws or bolts to prevent tampering with the screws or bolts.

In an aspect of the present disclosure, the handle includes a first projection extending from a bottom end portion of the panel, a second projection extending from an upper end portion of the panel, and a connecting portion connecting the first projection and the second projection. At least one extension portion extends from the connecting portion to the panel between the first projection and the second projection to conceal a lock arranged in the orifice of the bracket.

In an aspect of the present disclosure, the lock arranged in the orifice of the bracket is configured to be opened by a near field communication (NFC) device, a key fob, a Bluetooth signal, or an electromagnetic signal.

In an aspect of the present disclosure, the bracket is configured to be at least partially concealed within the hull of the vessel.

BRIEF DESCRIPTION OF THE DRAWINGS

Various aspects and features of the present disclosure are described hereinbelow with reference to the drawings wherein.

DETAILED DESCRIPTION

Figure 1:
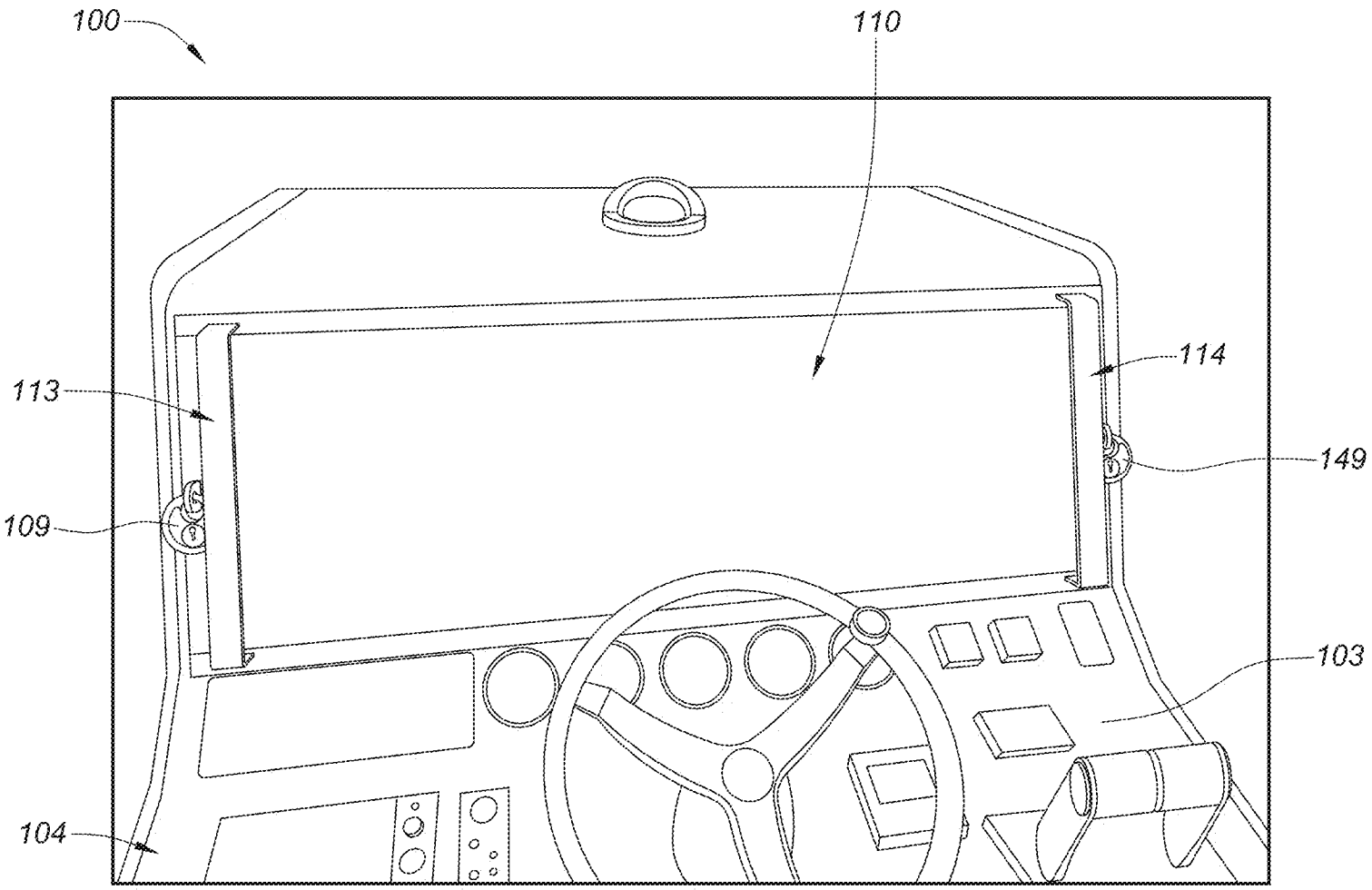
FIG. 1 is a front, perspective view of a system for preventing or deterring theft of marine electronics apparatus according to aspects of the present disclosure.
Figure 2B:
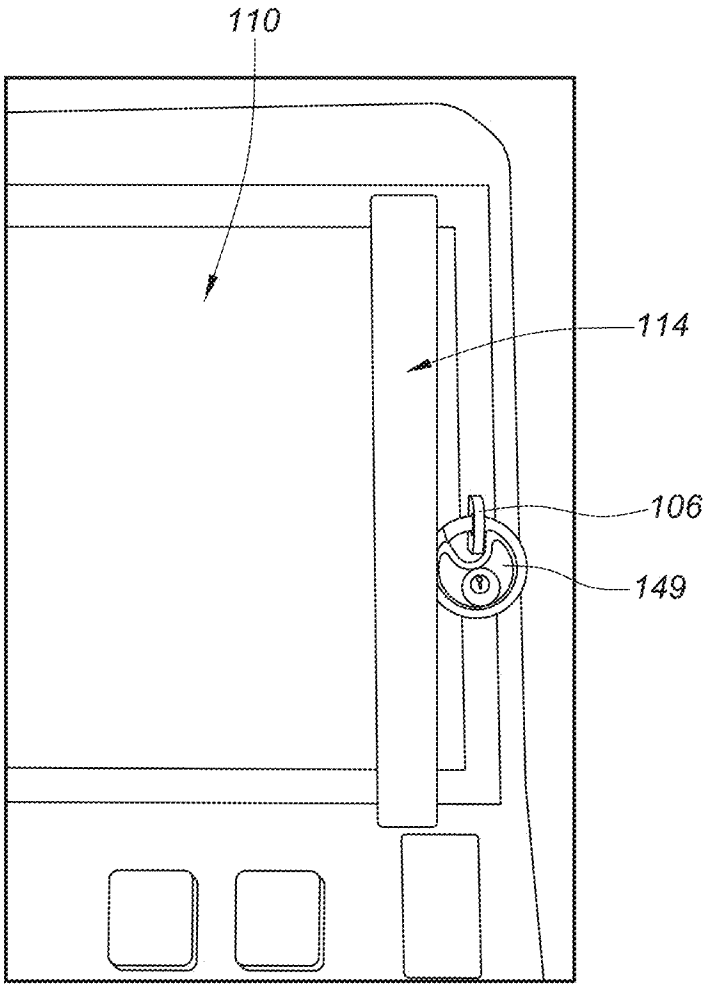
FIG. 2B is an enlarged, front view of a second handle and lock of the system of FIG. 1.
Figure 2A:
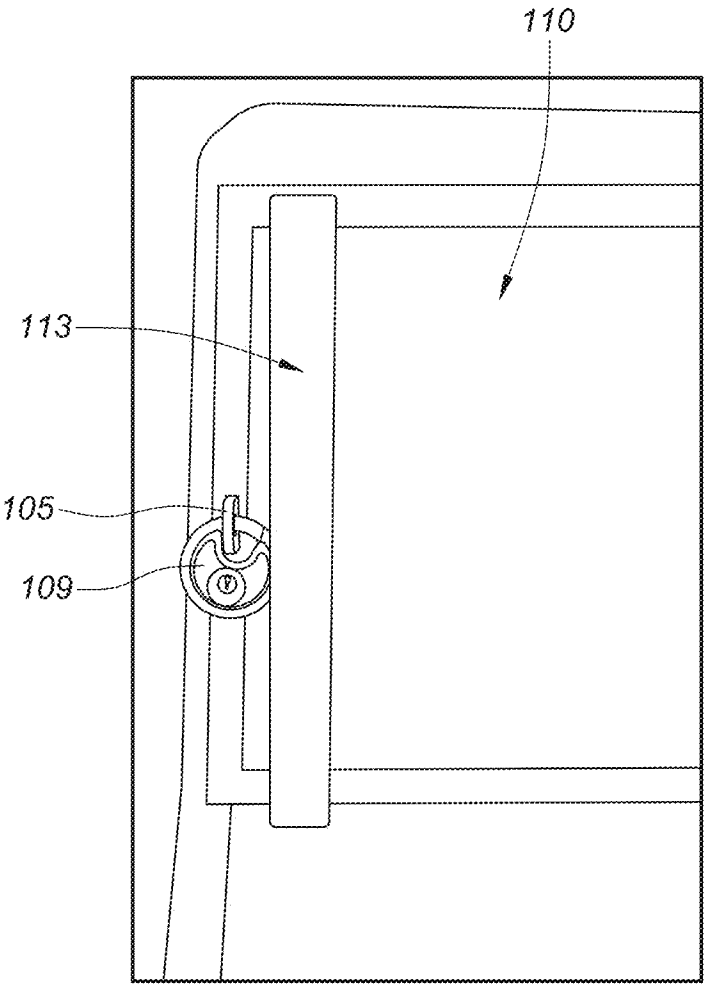
FIG. 2A is an enlarged, front view of a first handle and lock of the system of FIG. 1.
Figure 3B:
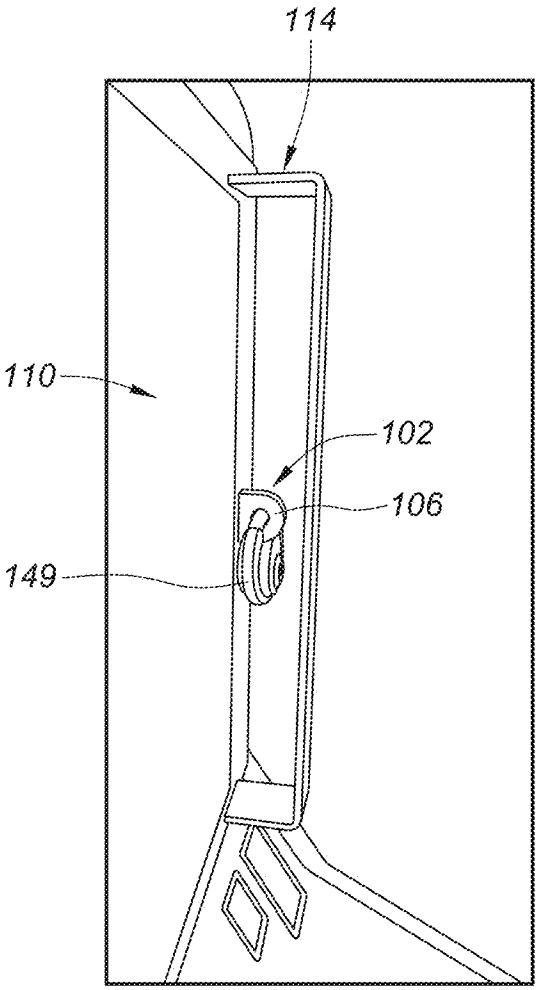
FIG. 3B is an enlarged, later view of the second handle and lock of the system of FIG. 1.
Figure 3A:
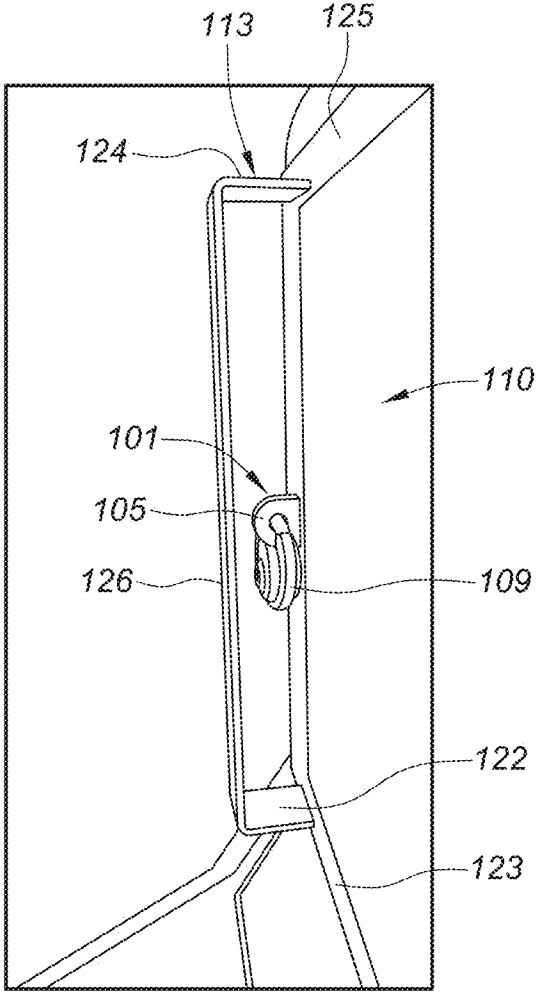
FIG. 3A is an enlarged, lateral view of the first handle and lock of the system of FIG. 1.
Figure 4B:
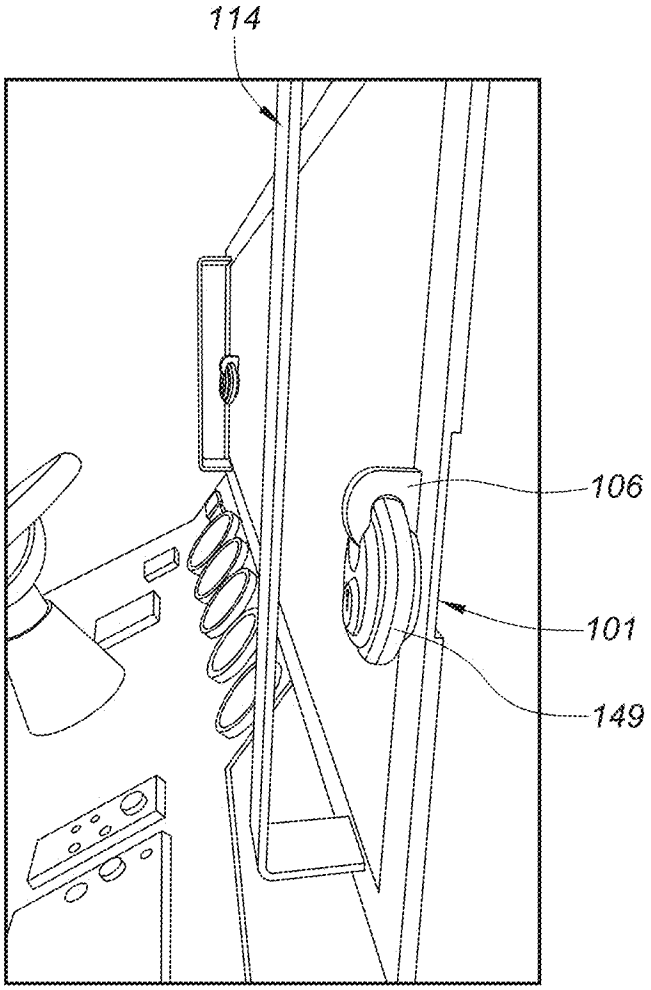
FIG. 4B is another enlarged, lateral view of the second handle and lock of the system of FIG. 1.
Figure 4A:
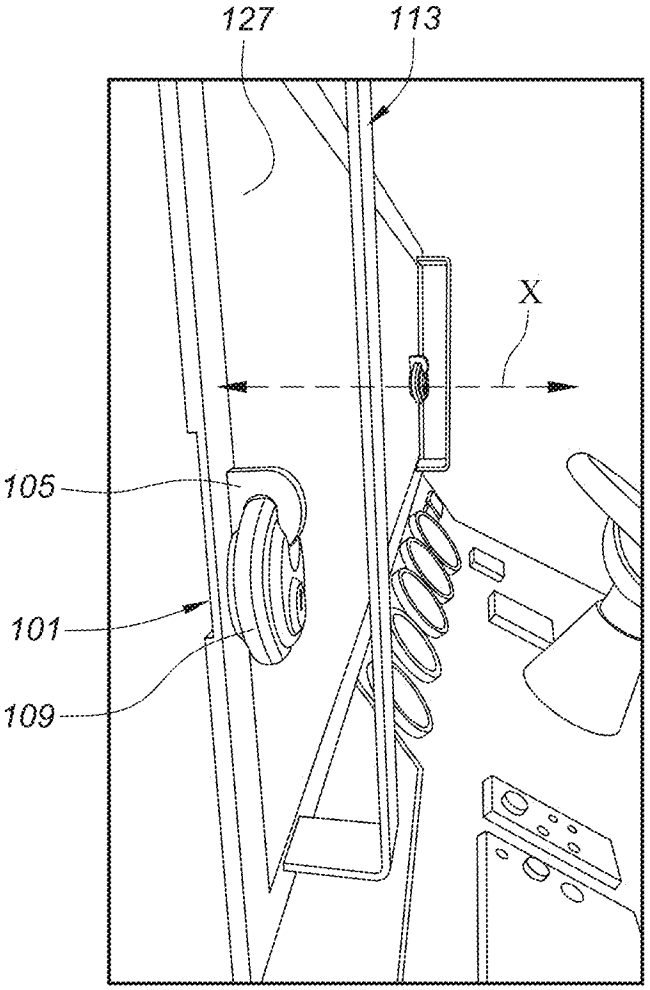
FIG. 4A is another enlarged, lateral view of the first handle and lock of the system of FIG. 1.
Figure 5B:
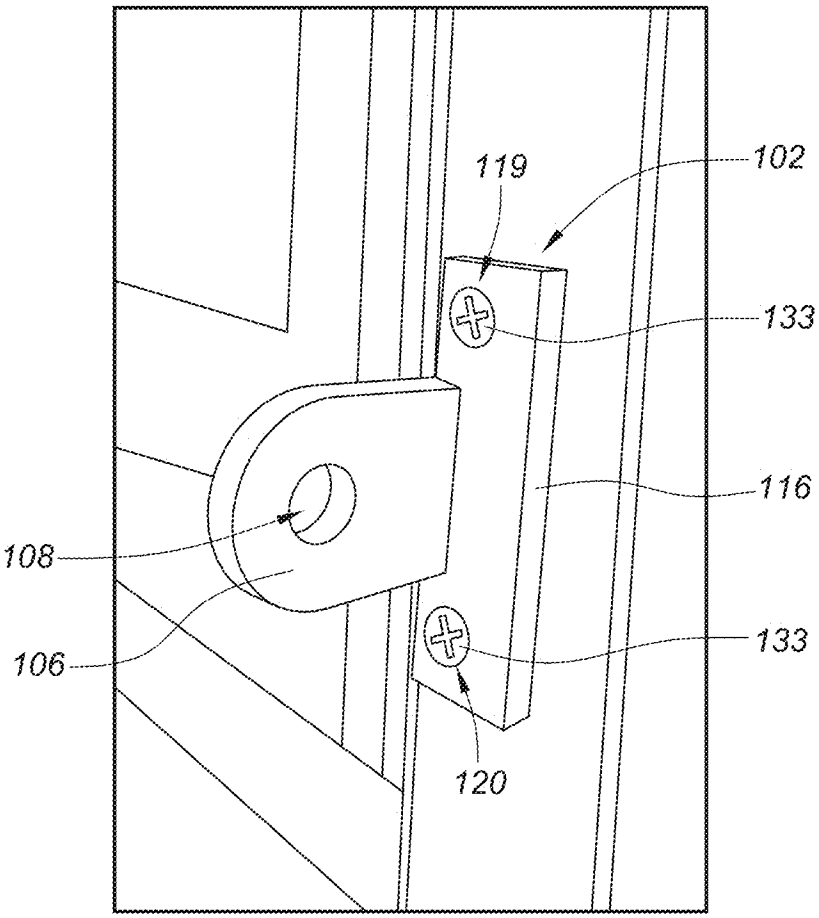
FIG. 5B is an enlarged, perspective view of a second bracket of the system of FIG. 1.
Figure 5A:
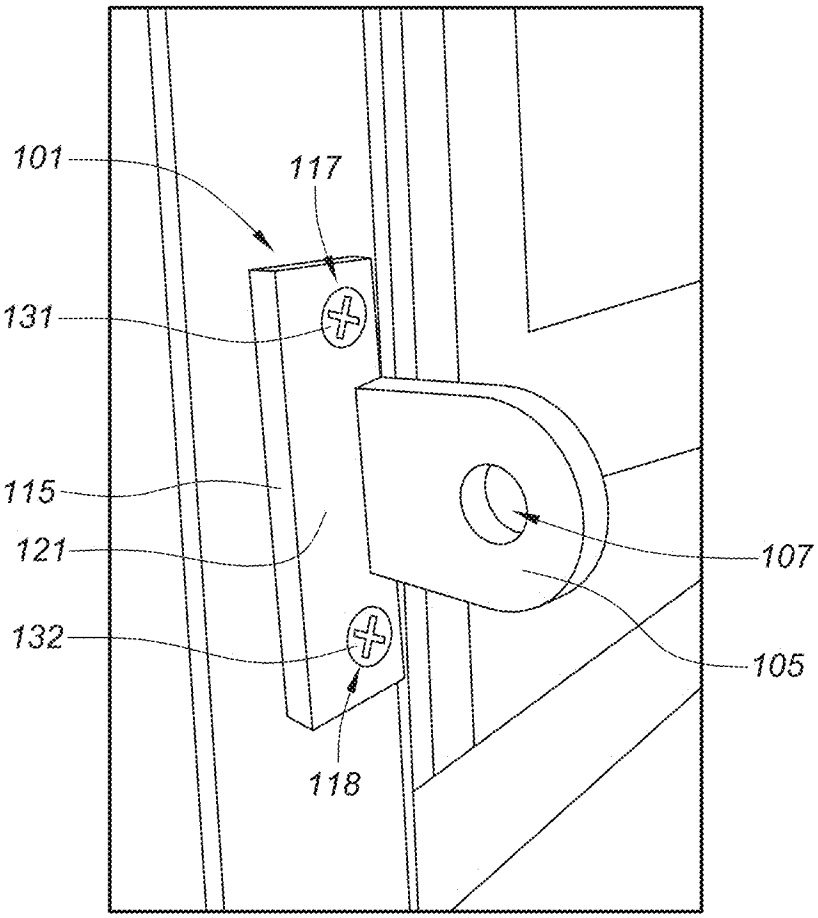
FIG. 5A is an enlarged, perspective view of a first bracket of the system of FIG. 1.
Figure 6B:
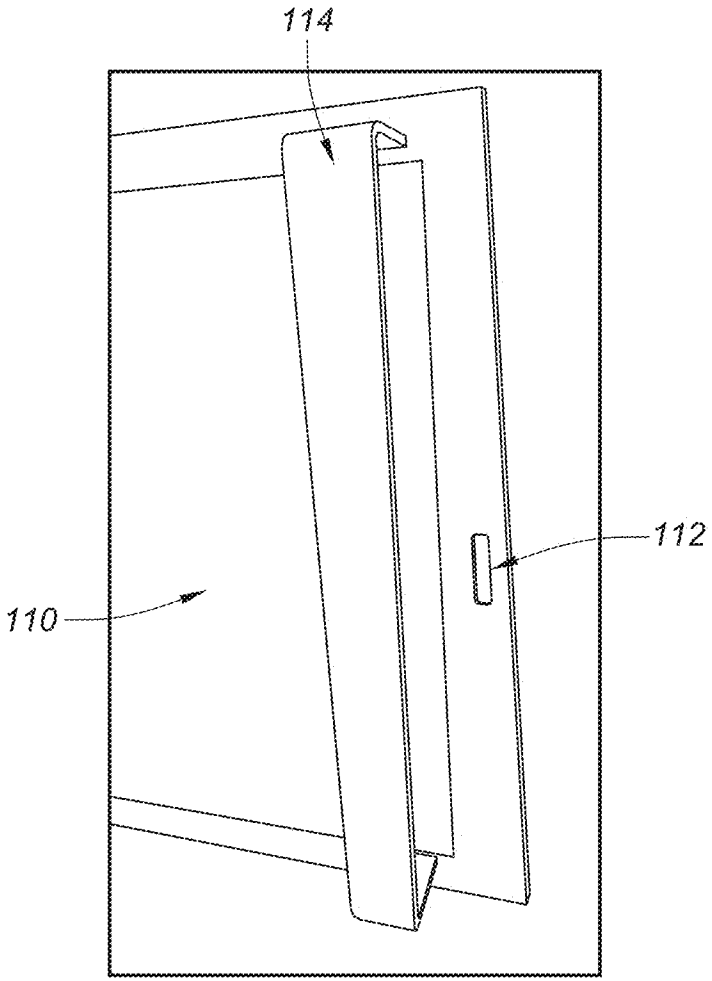
FIG. 6B is an enlarged, front view of the second handle and another orifice of the panel of the system of FIG. 1.
Figure 6A:
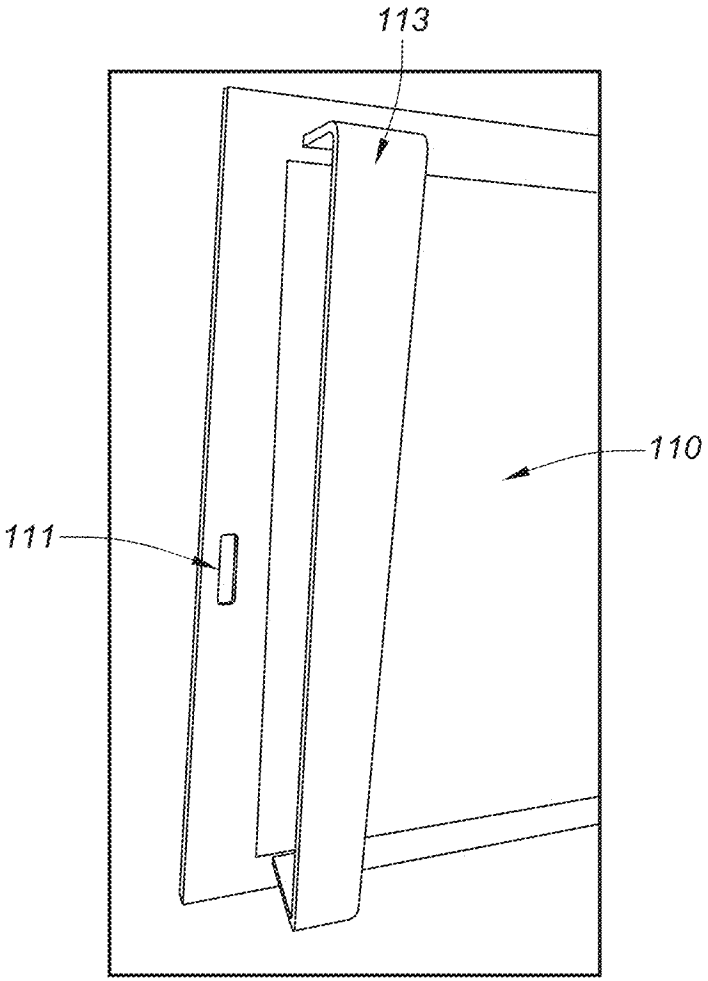
FIG. 6A is an enlarged, front view of the first handle and an orifice of the panel of the system of FIG. 1.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Exemplary configurations of the disclosure will be described more fully below (e.g., with reference to the accompanying drawings). Like reference numerals or labels may refer to like elements throughout the specification and drawings.

While a single bracket, panel, handle, lock (or other locking mechanism) may be described herein as examples, multiple brackets, panels, handles, and/or locks may similarly be employed. Each of the multiple brackets, panels, handles, and/or locks may have substantially the same configuration as the single exemplary bracket, panel, handle, and/or lock, respectively.

Figure 10:
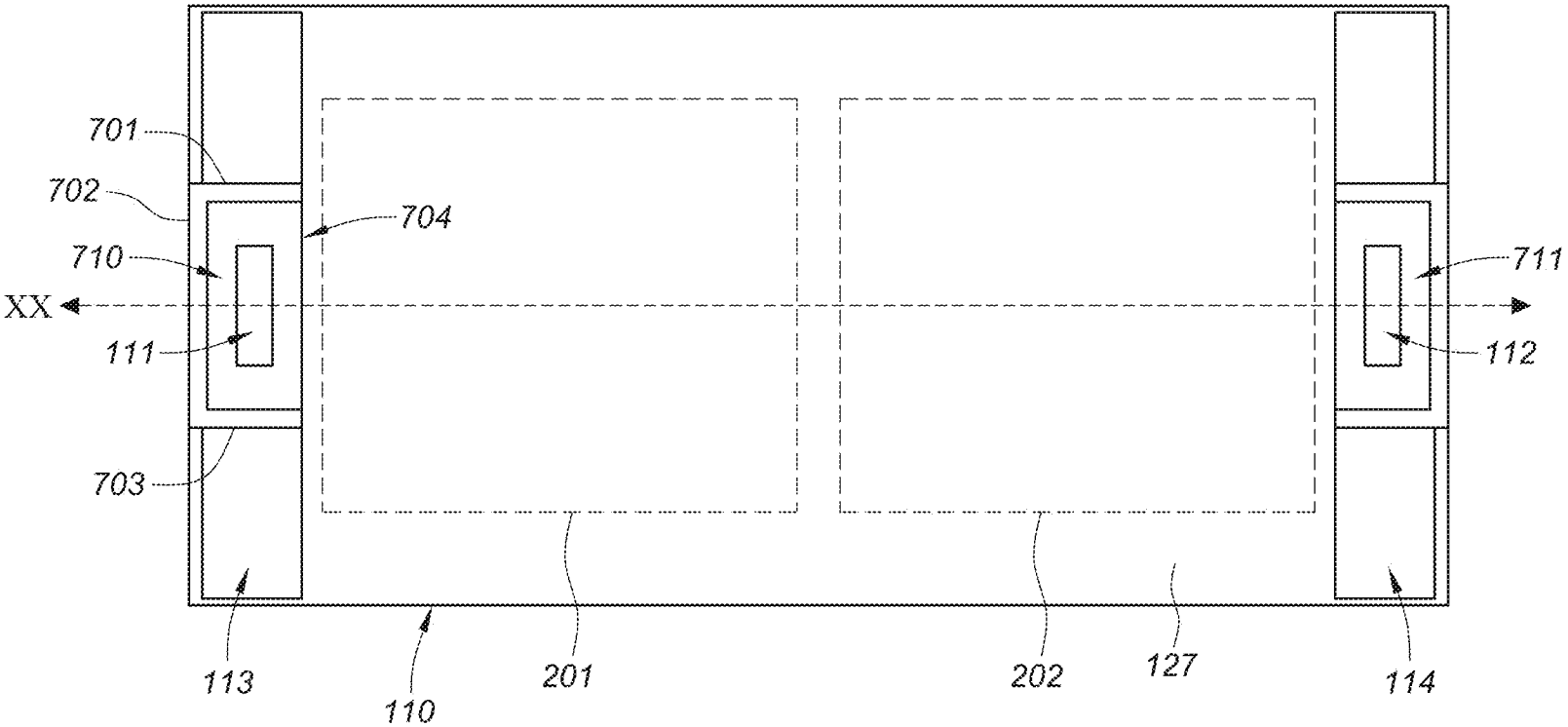
FIG. 10 is a schematic diagram of another arrangement of the handles and enclosures formed by the extension portion (s) of the handle employable by the system of FIG. 1.

Referring particularly to FIGS. 1 to 6B, a system 100 for preventing and/or deterring theft of marine electronics (e.g., marine electronics 201 and/or marine electronics 202 in FIG. 10) includes at least one bracket 101 and/or 102 configured to be mounted to a hull 103 of a vessel 104. While a single bracket 101 may be employed, the system 100 may also utilize multiple brackets, such as an arrangement of two or four brackets. The bracket(s) 101 and/or 102 include a projection 105 or 106 and an orifice 107 or 108 defined through the corresponding projection 105 or 106. The orifice 107 or 108 may be a substantially circular orifice, or other shapes may be employed to correspond with the shape of a locking arm of a lock (e.g., lock 109 or 149. The orifice 107 or 108 of the projection 105 or 106 is configured to receive a lock, particularly the locking arm of the lock.

A panel 110 is configured to be removably secured to the hull 103 of the vessel 104 by the bracket 101 and/or 102. While a single continuous panel may be employed, the system 100 may also be configured with multiple panels, such as a separate panel corresponding with each electronics unit installed in the vessel. That is, a separate panel may be individually fit to each electronics unit installed on a vessel, or a single panel may be arranged to cover a large array of multiple electronics units employing multiple screens, such as multiple flush mounted screens.

The panel 110 includes an orifice 111 and/or 112 in a position corresponding with each of the brackets 101 or 102. The orifice 111 or 112 of the panel 110 is configured to receive the corresponding projection 105 or 106 of the bracket 101 or 102 to secure the panel 110 to the hull 103 of the vessel 104. The panel 110 is configured to substantially cover at least one marine electronics unit to prevent theft of the marine electronics unit.

While the panel 110 may define a substantially flat inner (see, e.g., rear surface 130 of panel 110 in FIG. 9) and outer surface (see, e.g., front surface 127 of panel 110 in FIG. 10), the panel 110 may also be custom contoured (see, e.g., exemplary panel 1110 in FIG. 11A) to fit the unique shape of a desired portion of the hull of the vessel, and to minimize or substantially eliminate space between the panel and the hull of the vessel.

At least one handle 113 and/or 114 extends from the panel 110. The handle(s) 113 or 114 is/are configured to move the panel 110 between a first orientation (see, e.g., FIG. 1) in which the projection 105 or 106 of the bracket 101 or 102 is arranged in the orifice 111 or 112 of the panel 110 to secure the panel 110 to the hull of the vessel, and a second orientation (see, e.g., FIG. 8 or 9) in which the panel 110 is removed from the hull of the vessel.

The sizing of the panel 110 and arrangement of the brackets 101 or 102 can be modified and customized to accommodate any size hull, such as any size console (e.g., center console), helm or any size panel in a pilot house of a vessel. The size of the panel, and the arrangement of the panel/brackets can also be customized to accommodate any arrangement of marine electronics.

In use, brackets (e.g., 101 and/or 102) are installed at desired locations on a vessel hull, such as a center console of a vessel adjacent marine electronics. A panel (e.g., panel 110) that is dimensioned and shaped to receive the corresponding projections 105 or 106 of the bracket(s) 101 or 102 is then positioned to cover the marine electronics. The lock(s) (e.g., locks 109 or 149) is then inserted into the projection(s) 105 or 106 of the bracket(s) 101 or 102 and locked to secure the panel 110 to the hull of the vessel. The system 100 is designed to prevent and substantially eliminate the possibility of removing the panel 110, so that the marine electronics covered by the panel cannot be removed by a thief. In particular, a flush mounted electronics array including any number of flush mounted screens can be covered by the system 100 described herein, and unwanted removal of the electronics may thus be prevented by the system 100.

The panel 110 may also be used to cover a storage compartment defined in the hull of the vessel (e.g., in the console, such as the center console, or helm) and housing the marine electronics units. As an example, the panel 110 may cover a door or hatch, such as a transparent door, defined in a helm or console and arranged to cover a storage compartment housing the marine electronics.

In an aspect of the present disclosure, the bracket 101 or 102 includes a base member 115 or 116 (see, e.g., FIGS. 5A and 5B) configured to be secured to the hull of the vessel and the projection 105 or 106 extends from the base member 115 or 116. The bracket 101 or 102 may be a single integrally formed unit in which the projection 105 or 106 and base member 115 or 116 are formed together without welding two or more parts together. This increases the strength of the brackets 101 or 102 and also reduces manufacturing costs for both the brackets 101 or 102 and the system 100 employing the brackets 101 and/or 102. At least one orifice (see, e.g., orifices 117, 118, 119, and/or 120 in FIGS. 5A and 5B) is defined through the base member 115 or 116 of the bracket 101 or 102. The orifice of the base member 115 or 116 is configured to receive a mounting member (see, e.g., mounting members 131, 132, 133, and 134 in FIGS. 5A and 5B) therethrough (e.g., a screw or bolt, such that a counter sunk head of a screw or bolt rests in the orifice of the bracket to secure the base member to the hull of the vessel). The counter sunk screw or bolt heads allow for a substantially flat surface (see, e.g., flat surface 121 in FIG. 5A) to be defined by the bracket 101 or 102 facing the panel 110, which minimizes a space created between the panel 110 and the hull (e.g., center console) of the vessel (e.g., in the case of a surface-mounted bracket).

In an aspect of the present disclosure, the base member 115 or 116 defines a substantially flat surface (see, e.g., flat surface 121 in FIG. 5A) configured to contact the panel 110 (e.g., to contact a corresponding flat surface of the panel) when the panel 110 is secured to the hull of the vessel. As an example, an inner surface (see, e.g., rear surface 130 in FIG. 9) of the panel 110 configured to face the marine electronics may define or include a flat surface (see, e.g., flat surface 801 in FIG. 8) configured to directly contact the flat surface (e.g., flat surface 121 in FIG. 5A) of the bracket(s) 101 or 102. This minimizes the amount of space between the panel 110 and the hull of the vessel. While the brackets 101 or 102 may be directly surface-mounted to the hull of the vessel, the brackets 101 or 102 may also be at least partially recessed or retractable into the hull of the vessel, such that the panel 110 can directly contact the hull of the vessel.

The handles 113 or 114 may each include a first projection 122 extending from a bottom end portion 123 of the panel 110. A second projection 124 extends from an upper end portion 125 of the panel 110. A connecting portion 126 connects the first projection 122 and the second projection 124 to define the handle 113 or 114. Thus, the arrangement of the handle 113 or 114 creates a space between the handle 113 or 114 and the front surface 127 of the panel 110.

Figure 7:
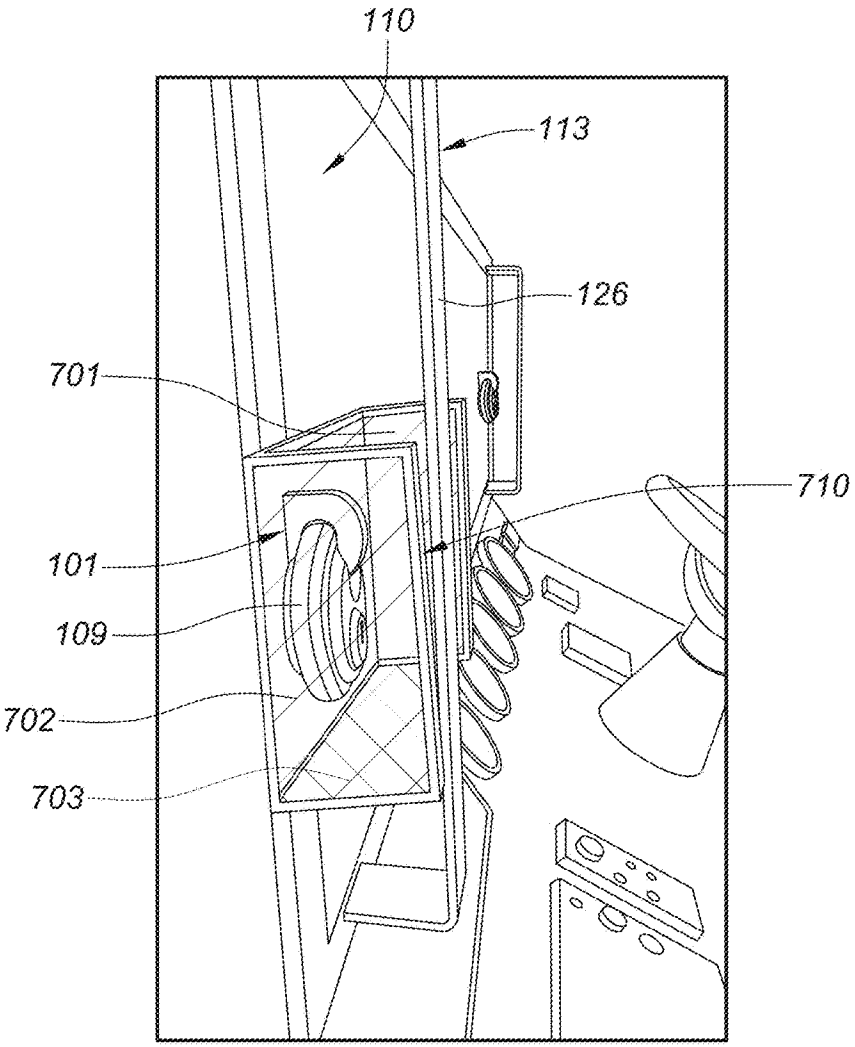
FIG. 7 is an enlarged, lateral, phantom view of a number of extensions extending from a connection portion of the first handle of the system of FIG. 1.

Referring particularly to FIGS. 7 and 10, in an aspect of the present disclosure, the connecting portion 126 of the handle 113 or 114 is configured to overlap with the bracket 101 or 102 along an axis (see, e.g., axis X in FIG. 4*a*) orthogonal to a front surface 127 of the panel 110 configured to face away from the marine electronics unit to prevent tampering with a lock arranged in the orifice of the projection (see, e.g., FIG. 10 in which the orthogonal axis X would extend out of the plane of the page). That is, the brackets/locks may be arranged behind the handles.

At least one extension portion (see, e.g., extension portions 701, 702, and/or 703 in FIG. 7) may extend from the connecting portion 126 of the handle 113 to the panel 110 between the first projection 122 and the second projection 124 to conceal a lock (e.g., lock 109) arranged in the orifice 107 of the bracket 101. As an example, a series of extensions (see, e.g., extension portions 701, 702, and/or 703 in FIG. 7) extending from the handle 113 to the panel 110 may form an enclosure 710 for the bracket/lock that conceals the bracket/lock on up to five sides. In an arrangement in which the brackets/locks are each concealed on five sides (e.g., by the panel 110, handle 113, and three extension portions 701, 702, and 703), only an opening 704 (see, e.g., FIG. 10) facing the center of the panel 110 would allow access to the brackets/locks. This substantially minimizes physical access to the brackets/locks, thus deterring and preventing tampering with the brackets/locks by a thief. In FIG. 7, the illustrated extension portions are shown with dashed lines (i.e., in phantom) to allow visualization of the bracket and lock concealed by the extension portion(s) in the enclosure formed by the combination of the bracket, handle, and three extension portions. A substantially identical enclosure may be formed around a second lock (e.g., lock 149) at an opposite side of the panel.

In an aspect of the present disclosure, a single extension portion (e.g., extension portion 702) may be employed on a lateral side of the panel 110 (i.e., facing out of the plane of the page in FIG. 7) and extending from the handle to the front surface of the panel.

As an example, in a system employing two brackets supporting opposite sides of a panel between the upper and lower portions of the panel, the five-sided enclosures for the brackets/locks may face each other across a center portion of the panel. That is, the brackets, locks, and enclosures may all be aligned with each other along a central horizontal axis of the panel.

Figure 8:
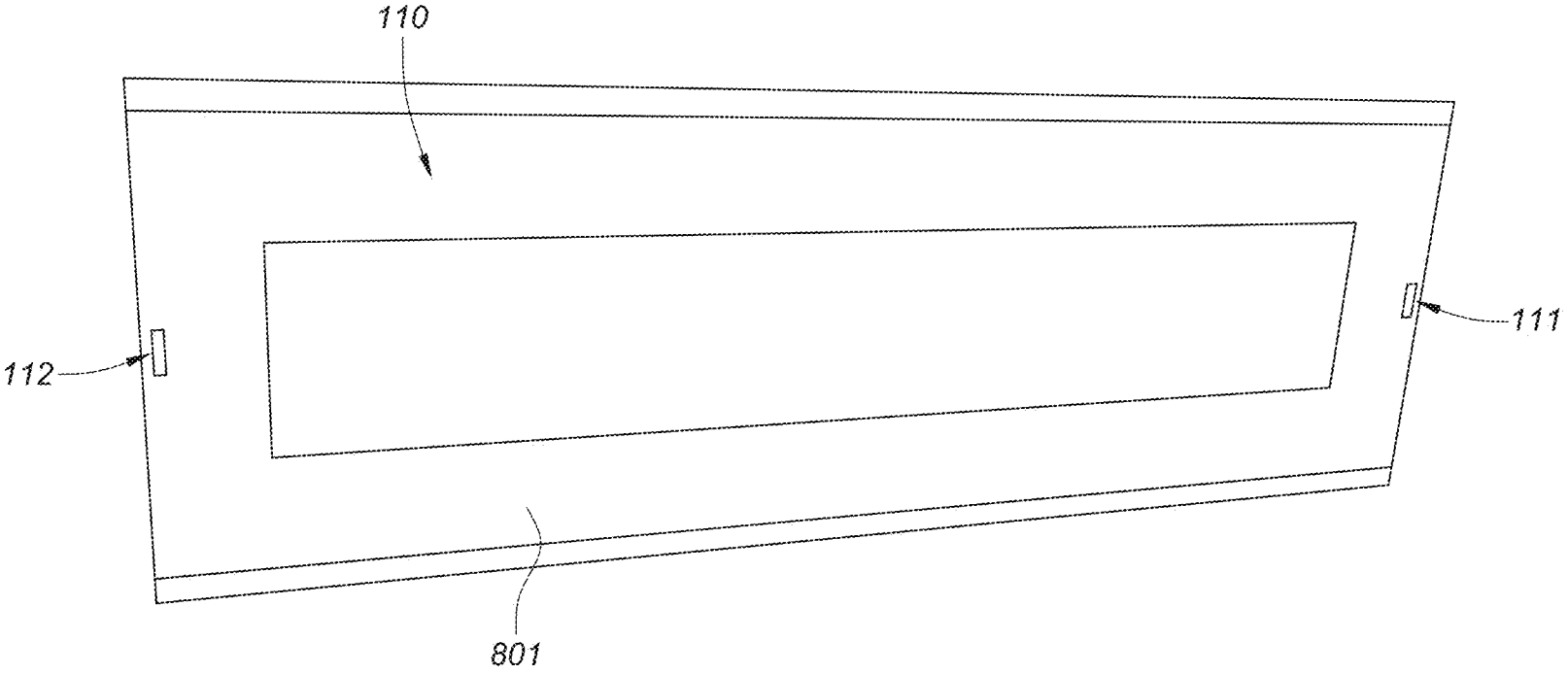
FIG. 8 is a rear, perspective view of the panel of the system of FIG. 1.
Figure 9:
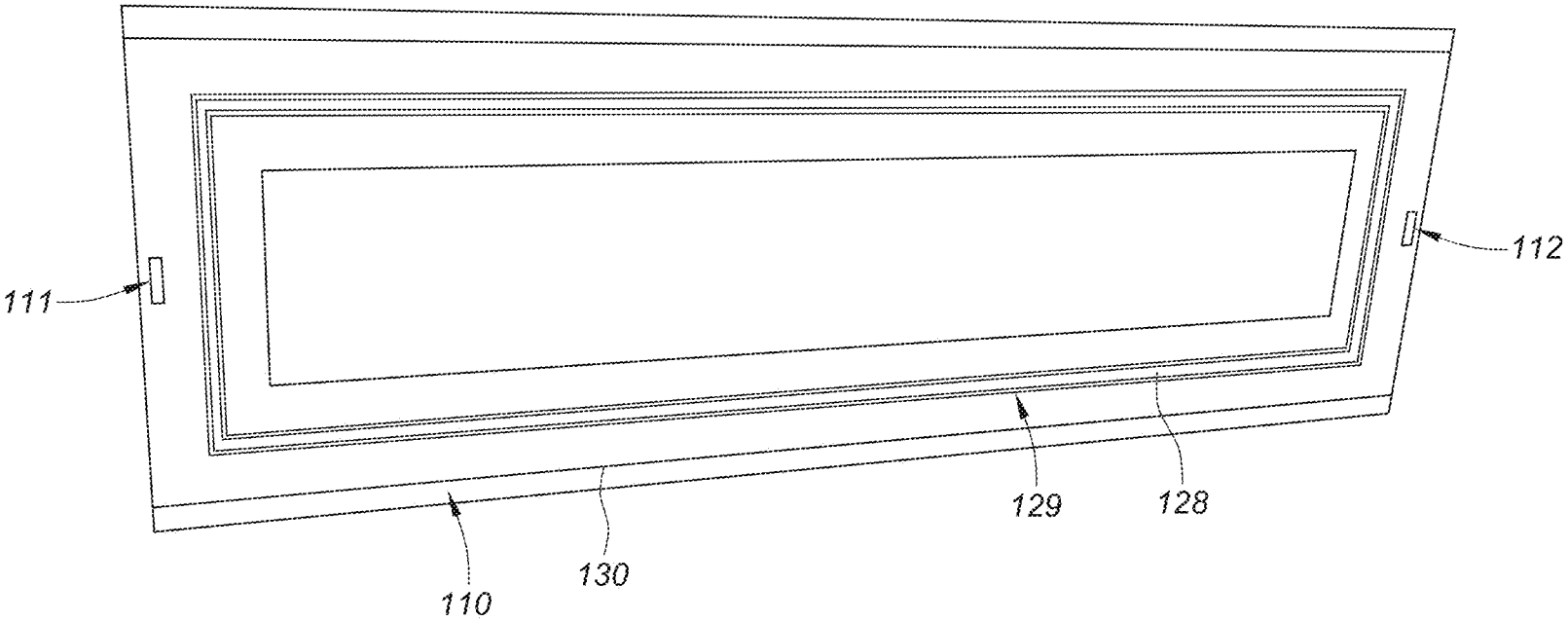
FIG. 9 is a rear view of another panel including a channel and gasket employable by the system of FIG. 1.

Referring particularly to FIGS. 8 to 9, a gasket 128 may be arranged around a perimeter of the panel 110 between the panel and the hull of the vessel. The gasket 128 may be arranged on an edge, inner or rear surface of the panel 110 configured to face the hull of the vessel and the marine electronics. The gasket 128 is configured to close a gap between the panel 110 and the hull of the vessel to prevent tampering with the panel 110 or the concealed marine electronics units. The gasket 128 also prevents damage to underlying structures, such as the hull, helm, or console of the vessel.

In an aspect of the present disclosure, a groove or channel 129 is formed on a rear surface 130 of the panel 110 configured to face the marine electronics unit. The gasket 128 is partially arranged in the groove 129 and partially protrudes from the groove 129 to secure the gasket 128 to the panel 110 and to close the gap between the panel 110 and the hull of the vessel to prevent tampering with the panel 110. However, the groove 129 may be partially or completely omitted, and the gasket 128 may be arranged directly on the panel 110. The gasket 128 may be arranged completely circumferentially around the perimeter region of the panel 110, or gaps may be formed in the gasket (e.g., to accommodate protruding portions of the hull of the vessel or other objects arranged between the hull of the vessel and the panel).

In an aspect of the present disclosure, the gasket includes rubber, silicone, neoprene, aramid fibers, glass fibers, non-asbestos fibers, elastomers, Polytetrafluoroethylene (PTFE), Polyvinyl chloride (PVC), graphite, cork, or plastic.

Figure 11A:
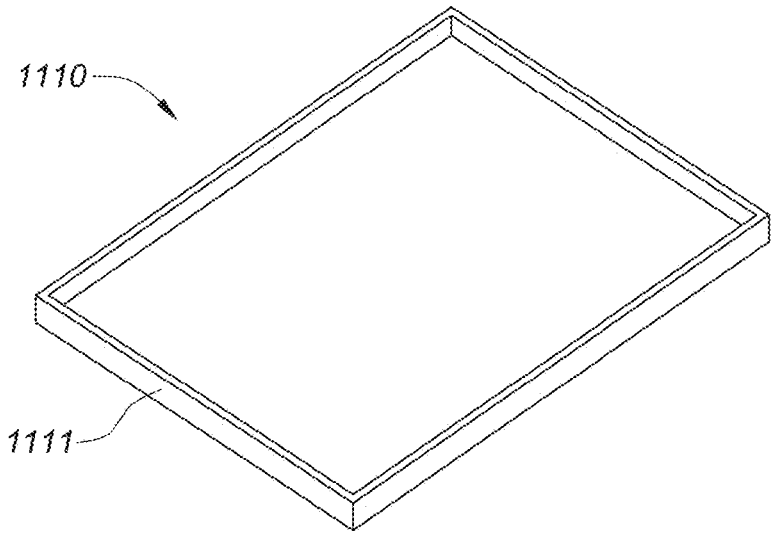
FIG. 11A is a perspective view of another panel employable by the system of FIG. 1.
Figure 11B:
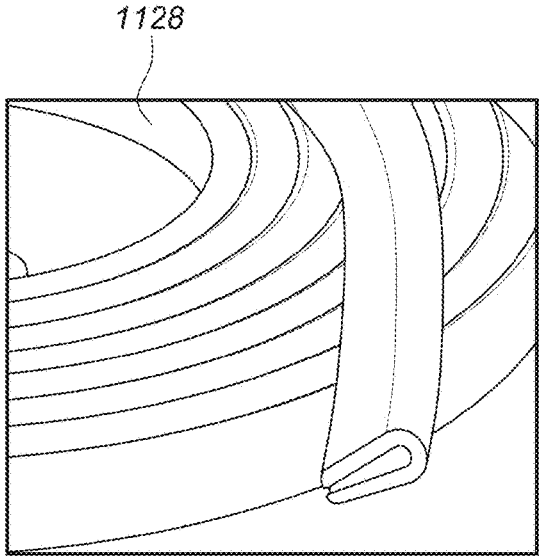
FIG. 11B is a perspective view of a first gasket employable by the panel of FIG. 11A.
Figure 11C:
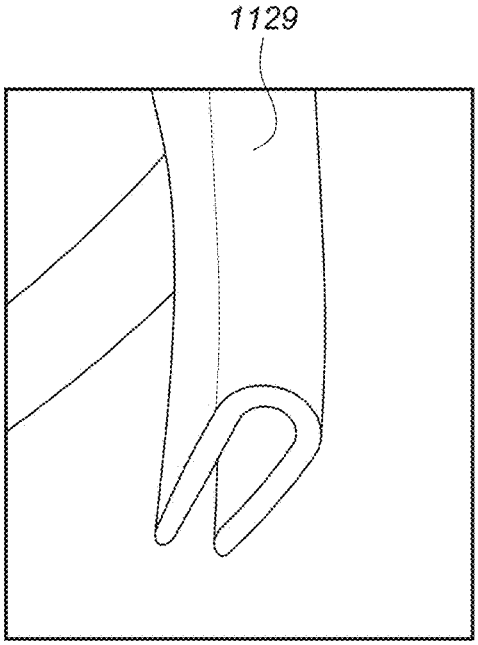
FIG. 11C is a perspective view of a second gasket employable by the panel of FIG. 11A.

While the gasket may be employed to close a gap between the hull (e.g., helm, or console) of the vessel and the panel, the panel 1110 may also include a series of lips 1111 folded or extending from the main body of the panel 1110 (see, e.g., FIG. 11A). The lips 1111 may be extensions of metal folded or extending from the main body of the panel 1110 and configured to extend toward the hull of the vessel. The gasket may be arranged on a distal-facing surface of the lips to face (e.g., to come into direct contact with) the hull of the vessel to close a gap between the main body of the panel and the hull of the vessel. As an example, the gasket arranged around the distal-facing lips may define a C or U shape that wraps around the lips of the panel (see, e.g., gasket 1128 in FIG. 11B or gasket 1129 in FIG. 11C).

In an aspect of the present disclosure, at least one of the bracket(s), the panel, or the handle(s) include(s) a metal. The metal may include stainless steel, galvanized steel, carbon, a steel alloy, brass, aluminum, or bronze. Any of the metal components may be powder coated, vinyl coated, and/or may include a self-healing coating. Any of the metal components may include a non-scratch coating.

As an example, a first bracket is configured to be mounted to a first side of a center console of the hull of the vessel, and a second bracket is configured to be mounted to a second side of the center console of the hull of the vessel opposite the first side. A first orifice of the panel is configured to be aligned with the first bracket, and a second orifice of the panel is configured to be aligned with the second bracket. The first and second bracket may be aligned with a central horizontal axis of the panel (see, e.g., axis XX in FIG. 10).

In an aspect of the present disclosure, the bracket is configured to be secured to the hull of the vessel by a number of screws or bolts. The panel is configured to cover the heads of each of the screws or bolts to prevent tampering with the screws or bolts. That is, the panel is arranged to cover the base portion of the brackets so that the screws or bolts cannot be accessed without removing the panel from the brackets. This prevents unwanted removal of the brackets by a thief when the panel is locked to the hull of the vessel.

In an aspect of the present disclosure, the bracket is configured to be at least partially concealed or recessed within the hull of the vessel. As an example, the base member of the projection may be flush with an outer surface of the hull of the vessel, such that only the projection extends from the hull of the vessel.

The brackets may each include an extendable/retractable (e.g., spring loaded) projection that can also be concealed within the hull of the vessel. The brackets may include a cover the completely conceals the base member and the projection of the bracket within the hull of the vessel. This prevents unwanted contact with the brackets during operation of the vessel.

In an aspect of the present disclosure, the lock arranged in the orifice of the bracket is configured to be opened by a near field communication (NFC) device, a key fob, a Bluetooth signal, an electromagnetic signal, a combination, or a key.

In use, the enclosure created by the extension portion(s) of the panel (see, e.g., FIG. 7) allows enough room for the lock to be manipulated from a side of the enclosure facing a center of the panel. The enclosure may be dimensioned, shaped, and positioned such that a key can be used to open the lock, or a keypad of the lock with a unique combination can be accessed. However, the enclosure may also be dimensioned, shaped, and positioned such that the lock(s) can be coupled with the corresponding bracket(s), but the lock is not easily accessed by a key or to access a keypad or combination dial of the lock. In the case of the lock being harder to access, the lock(s) can be opened by a wireless signal, such as the near field communication (NFC) device, the key fob, the Bluetooth signal (e.g., originating in a smartphone or a standalone hardware device), or another electromagnetic signal. A Smartphone or tablet may employ a software application programmed to control the functions of the lock(s).

The wireless signal may also be received from a remote location, such as via the cloud and may be delivered by one or more of a Wi-Fi signal, a Bluetooth signal, or a signal from the cellular network system.

The lock(s) may also interface with a software application running on at least one of the marine electronics units installed on the vessel. As an example, the lock may be smartlock embodying computer components and may be configured to be wirelessly/remotely operated and custom programmed. The smartlock may come pre-installed with firmware for operating the smartlock by interfacing with another device, such as a smartphone, tablet computer, laptop computer, or desktop computer.

The computer described herein may be embodied in a Smartphone. The Smartphone may emit any of the unlocking signals to the locks described herein. Thus, in use, the smartphone can be employed as a key (e.g., as a wireless key) for the lock(s) used to secure the panel to the hull of the vessel. Alternatively, a tablet computer may be employed instead of or in conjunction with a smartphone.

Figure 12:
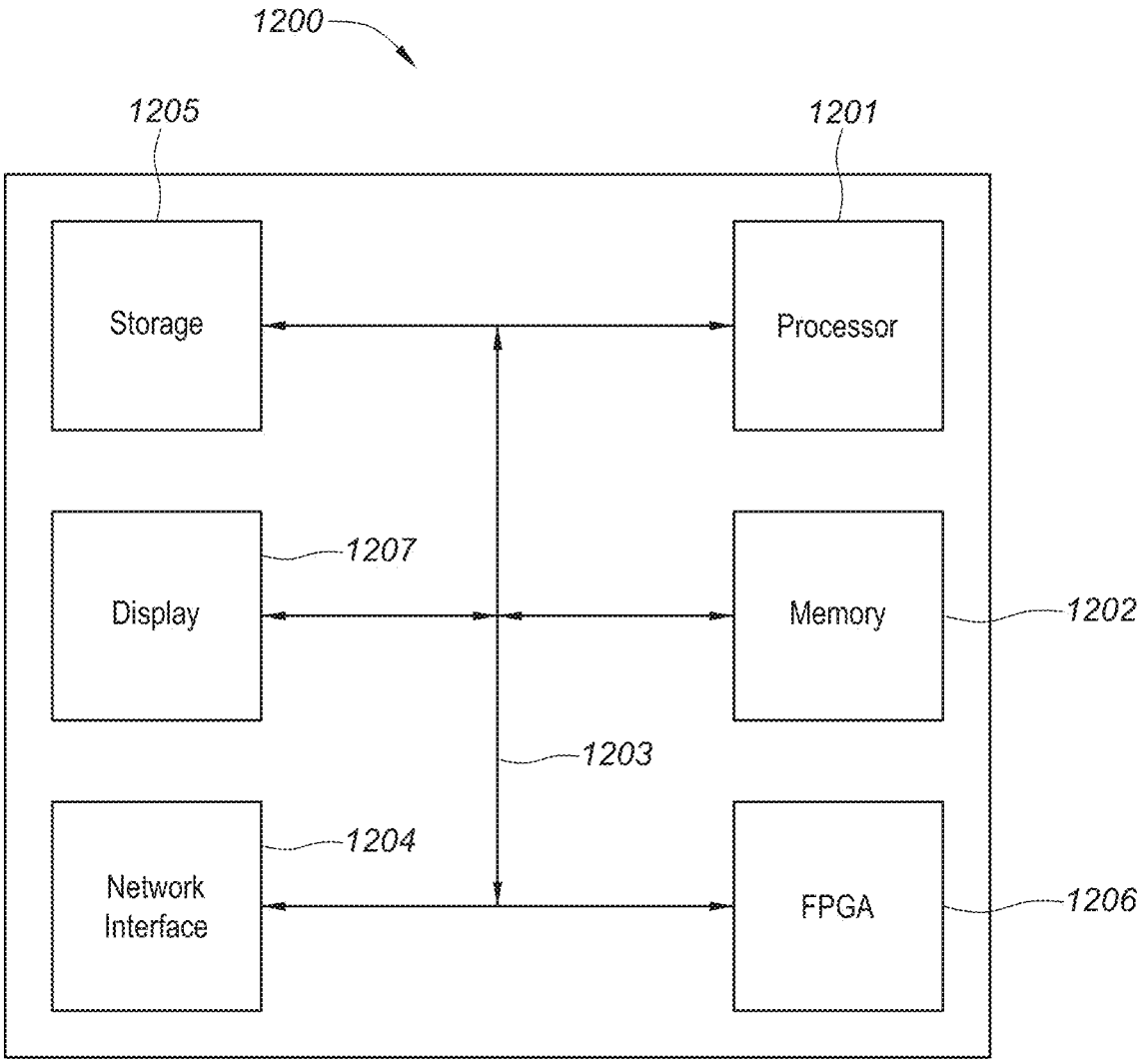
FIG. 12 is a block diagram of an exemplary computer employable by the devices and/or systems described herein according to aspects of the present disclosure.

Referring to FIG. 12, a general-purpose computer 1200 employable by the system described herein (e.g., by the lock) is described. The general-purpose computer 1200 can be employed by or embodied in the lock(s) and/or in a smartphone or tablet computer to perform the various functions described herein. The computer 1200 may include a processor 1201 connected to a computer-readable storage medium or a memory 1202 which may be a volatile type memory, e.g., RAM, or a non-volatile type memory, e.g., flash media, disk media, etc. The processor 1201 may be another type of processor such as, without limitation, a digital signal processor, a microprocessor, an ASIC, a graphics processing unit (GPU), field-programmable gate array (FPGA), or a central processing unit (CPU).

In some aspects of the disclosure, the memory 1202 can be random access memory, read-only memory, magnetic disk memory, solid state memory, optical disc memory, and/or another type of memory. The memory 1202 can communicate with the processor 1201 through communication buses 1203 of a circuit board and/or through communication cables such as serial ATA cables or other types of cables. The memory 1202 includes computer-readable instructions that are executable by the processor 1201 to operate the computer 1200 to execute the various functions described herein. The computer 1200 may include a network interface 1204 to communicate (e.g., through a wired or wireless connection) with other computers or a server. A storage device 1205 may be used for storing data. The computer 1200 may include one or more FPGAs 1206. The FPGAs 1206 may be used for executing various functions described herein. A display 1207 may be employed to display data processed by the computer 1200.

Figure 13A:
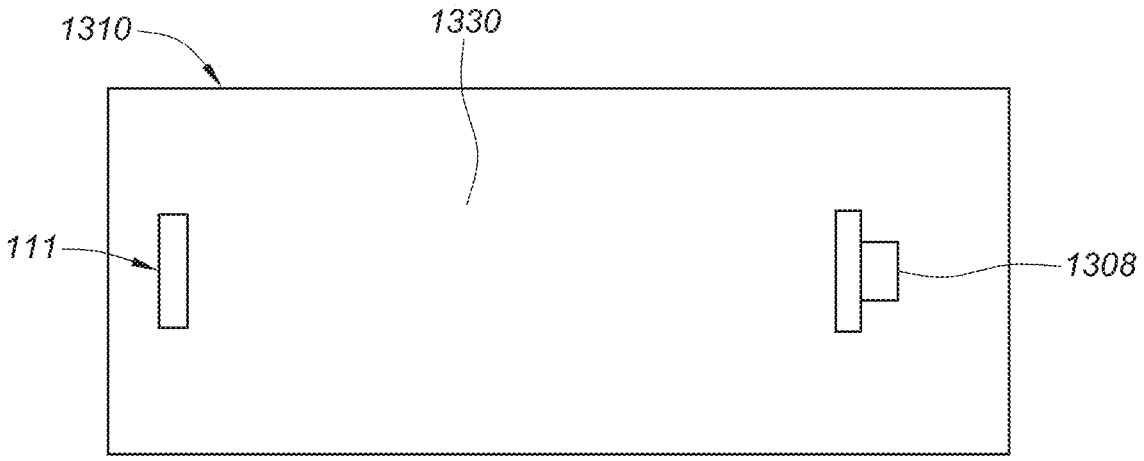
FIG. 13A is a rear view of an exemplary panel employable by the system of FIG. 1.
Figure 13B:
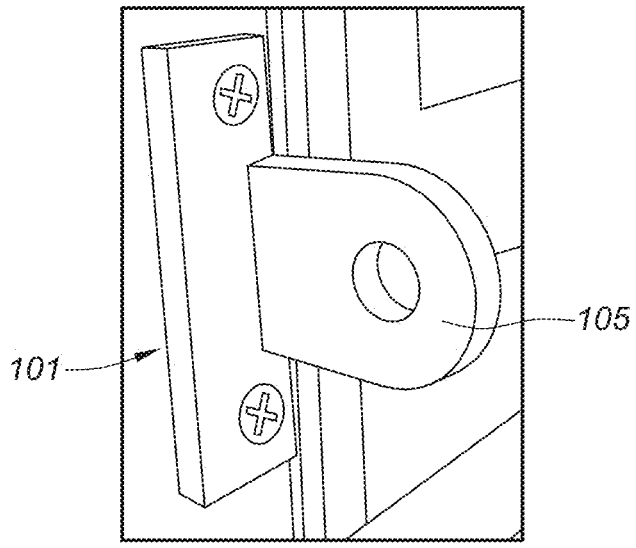
FIG. 13B is a perspective view of a first exemplary bracket employable to secure the panel of FIG. 13A.
Figure 13C:
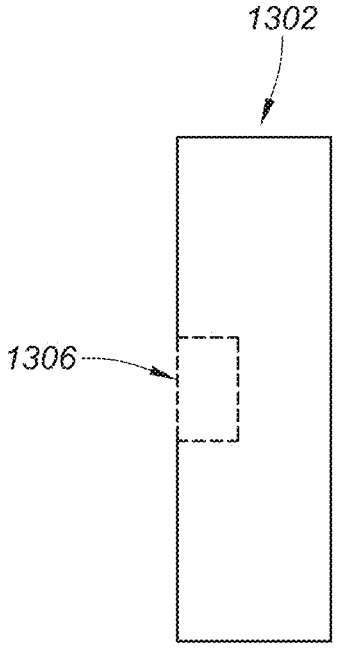
FIG. 13C is a rear view of a second exemplary bracket employable to secure the panel of FIG. 13A.

Referring particularly to FIG. 13, the first bracket 101 includes the projection 105 configured to extend through the orifice 111 in a panel 1310, and a second bracket 1302 includes a channel, orifice or indentation 1306 configured to receive a protrusion 1308 extending from a rear surface 1330 of the panel 1310. That is, in an exemplary embodiment, only one side of the panel 1310 would receive a protrusion 105 of a bracket 101, and the second bracket 1302 would be arranged entirely behind the panel and would receive the protrusion 1308 of the panel 1310 extending from the rear surface 1330 of the panel 1310 to secure the panel 1310 in position. The protrusion 1308 might be one or more teeth extending from the rear surface 1330 of the panel 1310 and received within the channel or an orifice 1306 of the second bracket 1302. This arrangement allows only a single lock to be utilized while securing one side of the panel 1310 without the use of a second protrusion extending through the panel 1310. This arrangement also allows only a single orifice 111 to be formed in the panel 1310 on one side of the panel.

Figure 14A:
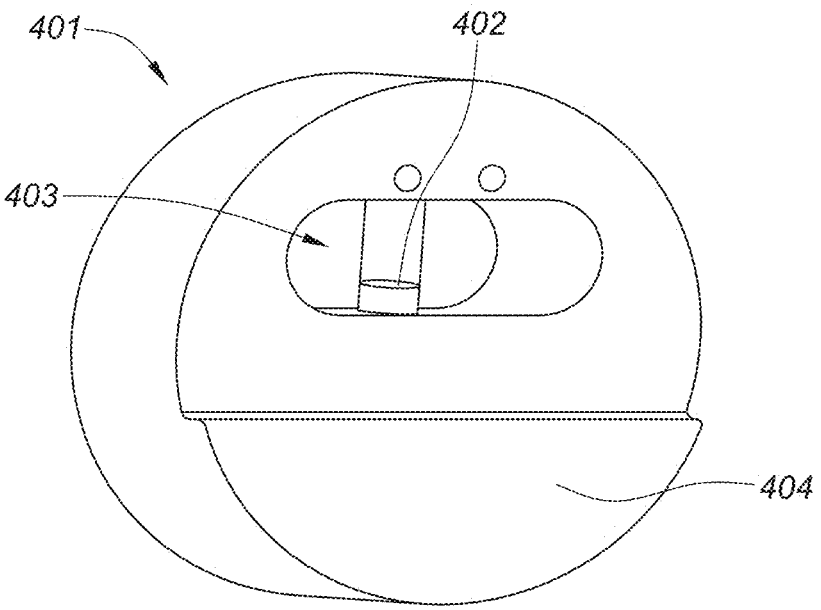
FIG. 14A is a rear, perspective view of a lock employable by the system of FIG. 1.
Figure 14B:
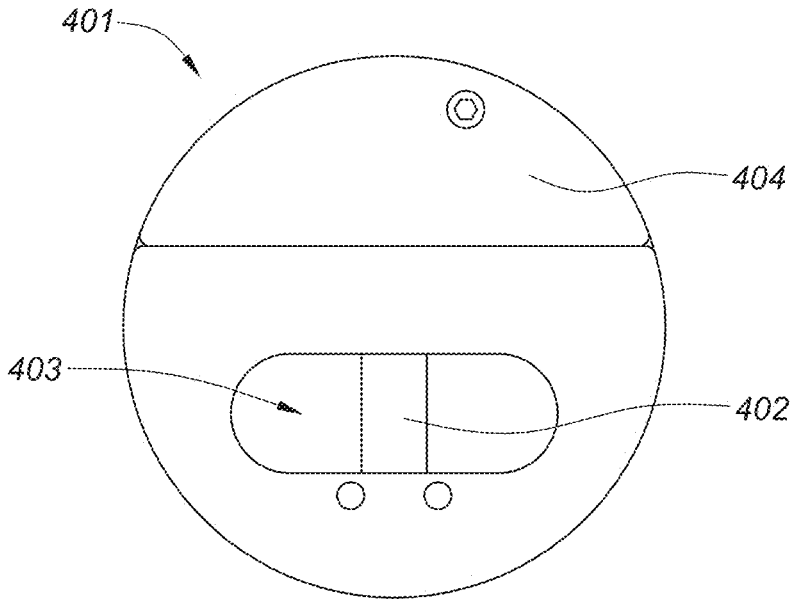
FIG. 14B is a rear view of the lock of FIG. 14A.
Figure 15A:
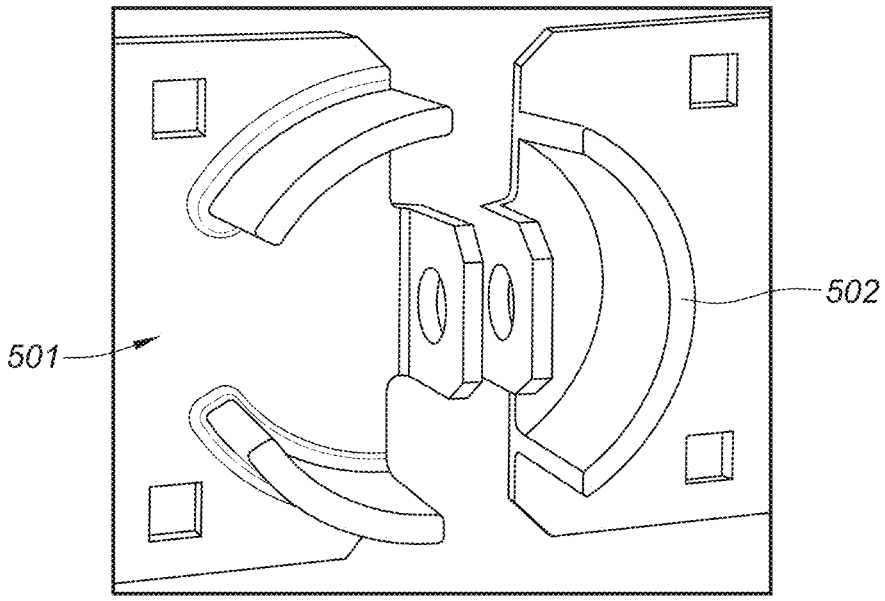
FIG. 15A is a perspective view of a pair of brackets configured to receive the lock of FIG. 14A.
Figure 15B:
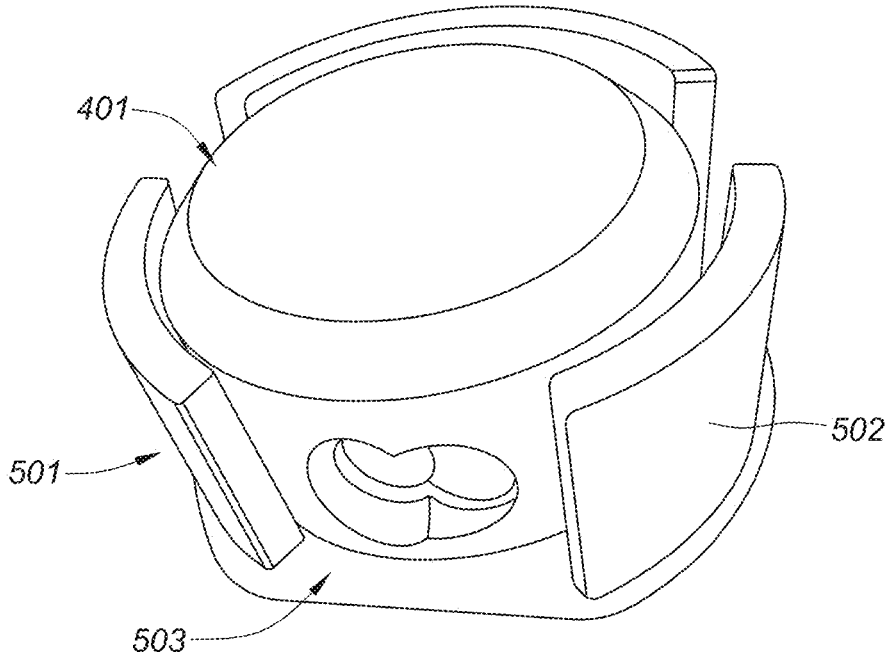
FIG. 15B is a perspective view of the brackets of FIG. 15A including the lock of FIG. 14A coupled thereto.

Referring particularly to FIGS. 14A-15B, the bracket 101 or 102 may be configured to receive a hidden shackle lock, such as the exemplary hidden shackle lock 401 illustrated in FIGS. 14A and 14B. A hidden shackle lock, also referred to as a shrouded or concealed shackle padlock, is a type of lock designed for enhanced security and protection against tampering. The hidden shackle lock 401 includes a concealed shackle 402 (also referred to as a locking mechanism) concealed in a channel 403 defined in the rear of the lock body 404. The concealed shackle 402 prevents tampering with the hidden shackle lock 401.

The hidden shackle lock 401 may be connected with a bracket 501 including at least one sidewall 502 configured to cover a side surface of the hidden shackle lock 401. The bracket 501 may include a number of sidewalls 502 arranged circumferentially around bracket 501. One or more gaps 503 may be defined between sidewalls 502 to provide access to a keyhole of the hidden shackle lock 401.

Each orifice described herein may define a substantially circular shape; however, other shapes may also be employed to accommodate different locks, such as a square or rectangular shape. All of the components described herein may be formed of marine grade materials, such as marine grade metal (e.g., steel) that can withstand a saltwater environment without rusting or being otherwise degraded by exposure to the elements.

Many of the structures described herein (e.g., the handles, orifices in the panel, enclosures, locks, etc.) may be formed as pairs at opposite sides of the device/system described herein. Unless otherwise indicated herein a structure formed at a first side of the panel having a corresponding structure at an opposite side of the panel (e.g., a mirror image, symmetrical structure, or a pair of the first structure) may have substantially the same structure as the first described panel, and thus duplicative descriptions may be omitted herein. For example, one enclosure 710 is described with particular reference to FIGS. 7 and 10, but a symmetrically opposed structure (e.g., enclosure 711 in FIG. 10) may also be formed at an opposite side of the panel 110 to receive and conceal a second lock.

It will be understood that various modifications may be made to the aspects and features disclosed herein. Therefore, the above description should not be construed as limiting, but merely as exemplifications of various aspects and features. Those skilled in the art will envision other modifications within the scope and spirit of the claims appended thereto.

What is claimed is:

1. A system for preventing theft of marine electronics, comprising:

at least one bracket configured to be mounted to a hull of a vessel, wherein the at least one bracket includes a projection and at least one first orifice defined through the projection, wherein the at least one first orifice is configured to receive at least one lock therein;

a panel configured to be secured to the hull of the vessel by the at least one bracket, wherein the panel includes at least one second orifice configured to receive the projection of the bracket therein to secure the panel to the hull of the vessel, wherein the panel is configured to substantially cover at least one marine electronics unit to prevent theft of the at least one marine electronics unit; and at least one handle extending from the panel, wherein the at least one handle is configured to move the panel between a first orientation in which the projection of the bracket is arranged in the second orifice of the panel to secure the panel to the hull of the vessel, and a second orientation in which the panel is removed from the hull of the vessel, wherein the at least one handle includes:

a first projection extending from a bottom end portion of the at least one panel;

a second projection extending from an upper end portion of the at least one panel;

a connecting portion connecting the first projection and the second projection; and at least one extension portion extending from the connecting portion to the panel between the first projection and the second projection, wherein the at least one extension portion is configured to conceal a lock arranged in the first orifice.

2. The system of claim 1, further including a lock configured to be received in the at least one first orifice of the projection to secure the panel to the hull of the vessel.

3. The system of claim 1, wherein the at least one bracket includes a base member configured to be secured to the hull of the vessel, wherein the projection extends from the base member.

4. The system of claim 3, further including at least one third orifice defined through the base member of the at least one bracket, wherein the at least one third orifice is configured to receive a counter sunk head of a screw to secure the base member to the hull of the vessel.

5. The system of claim 4, wherein the base member defines a substantially flat surface configured to contact the panel when the panel is secured to the hull of the vessel.

6. The system of claim 1, wherein the connecting portion of the at least one handle is configured to overlap with the at least one bracket along an axis orthogonal to a front surface of the panel configured to face away from the at least one marine electronics unit to prevent tampering with a lock arranged in the at least one first orifice of the projection.

7. The system of claim 1, further including a gasket arranged around a perimeter of the panel, wherein the gasket is configured to close a gap between the panel and the hull of the vessel to prevent tampering with the panel.

8. The system of claim 7, further including a groove formed on a rear surface of the panel configured to face the at least one marine electronics unit, wherein the gasket is partially arranged in the groove to secure the gasket to the panel.

9. The system of claim 8, wherein the gasket includes rubber, silicone, neoprene, aramid fibers, glass fibers, non-asbestos fibers, elastomers, Polytetrafluoroethylene (PTFE), graphite, cork, or plastic.

10. The system of claim 1, wherein at least one of the at least one bracket, the panel, or the at least one handle include a metal.

11. The system of claim 10, wherein the metal includes stainless steel, galvanized steel, carbon, a steel alloy, brass, aluminum, or bronze.

12. The system of claim 1, wherein the at least one bracket includes:

a first bracket configured to be mounted to a first side of a center console of the hull of the vessel; and a second bracket configured to be mounted to a second side of the center console of the hull of the vessel.

13. The system of claim 12, wherein the at least one second orifice of the panel includes:

an orifice configured to be aligned with the first bracket; and another orifice configured to be aligned with the second bracket.

14. The system of claim 1, wherein the at least one handle includes:

a first handle extending from a first side of the panel; and a second handle extending from a second side of the panel opposite the first side of the panel.

15. The system of claim 1, wherein the at least one bracket is configured to be secured to the hull of the vessel by a plurality of screws or bolts, and wherein the panel is configured to cover heads of each of the plurality of screws or bolts to prevent tampering with the plurality of screws or bolts.

16. The system of claim 1, wherein the at least one bracket is configured to be at least partially concealed within the hull of the vessel.

17. A system for preventing theft of marine electronics, comprising:

at least one bracket configured to be mounted to a hull of a vessel, wherein the at least one bracket includes a projection and at least one first orifice defined through the projection, wherein the at least one first orifice is configured to receive at least one lock therein;

a panel configured to be secured to the hull of the vessel by the at least one bracket, wherein the panel includes at least one second orifice configured to receive the projection of the bracket therein to secure the panel to the hull of the vessel, wherein the panel is configured to substantially cover at least one marine electronics unit to prevent theft of the at least one marine electronics unit; and at least one handle extending from the panel, wherein the at least one handle is configured to move the panel between a first orientation in which the projection of the bracket is arranged in the second orifice of the panel to secure the panel to the hull of the vessel, and a second orientation in which the panel is removed from the hull of the vessel, wherein the at least one bracket includes:

a first bracket configured to be mounted to a first side of a center console of the hull of the vessel; and a second bracket configured to be mounted to a second side of the center console of the hull of the vessel, wherein the first bracket includes the projection, and wherein the second bracket includes a channel configured to receive at least one protrusion extending from a rear surface of the panel, wherein the rear surface of the panel is configured to face the at least one marine electronics unit.

18. A system for preventing theft of marine electronics, comprising:

at least one bracket configured to be mounted to a hull of a vessel, wherein the at least one bracket includes a projection and at least one first orifice defined through the projection, wherein the at least one first orifice is configured to receive at least one lock therein;

a panel configured to be secured to the hull of the vessel by the at least one bracket, wherein the panel includes at least one second orifice configured to receive the projection of the bracket therein to secure the panel to the hull of the vessel, wherein the panel is configured to substantially cover at least one marine electronics unit to prevent theft of the at least one marine electronics unit; and at least one handle extending from the panel, wherein the at least one handle is configured to move the panel between a first orientation in which the projection of the bracket is arranged in the second orifice of the panel to secure the panel to the hull of the vessel, and a second orientation in which the panel is removed from the hull of the vessel, wherein the at least one handle includes:

a first projection extending from a bottom end portion of the at least one panel;

a second projection extending from an upper end portion of the at least one panel;

a connecting portion connecting the first projection and the second projection; and at least one extension portion extending from the connecting portion to the panel between the first projection and the second projection, wherein the at least one extension portion is configured to conceal a lock arranged in the first orifice;

and wherein the lock arranged in the first orifice is configured to be opened by a near field communication (NFC) device, a key fob, a Bluetooth signal, or an electromagnetic signal.

* * * * *